United States Patent [19]

Wiebesiek

[11] Patent Number: 4,501,529

[45] Date of Patent: Feb. 26, 1985

[54] APPARATUS FOR FEEDING LAUNDRY ARTICLES TO AN IRONING MACHINE

[75] Inventor: Wilhelm Wiebesiek, Vlotho, Fed. Rep. of Germany

[73] Assignee: Herbert Kannegiesser GmbH & Co., Fed. Rep. of Germany

[21] Appl. No.: 374,817

[22] Filed: May 4, 1982

[30] Foreign Application Priority Data

May 19, 1981 [DE] Fed. Rep. of Germany ..... 3119880

[51] Int. Cl.[3] ..... D06F 67/04

[52] U.S. Cl. ..... 414/751; 38/143; 294/104; 414/736

[58] Field of Search ..... 294/101, 104; 414/749, 414/751, 736; 38/143; 198/485, 681

[56] References Cited

U.S. PATENT DOCUMENTS

| | | | |
|---|---|---|---|
| 3,421,756 | 1/1969 | Weir | 38/143 |
| 3,604,132 | 9/1971 | Thompson et al. | 38/143 |
| 3,960,264 | 6/1976 | Carbine et al. | 294/104 X |
| 4,106,227 | 8/1978 | Allen et al. | 38/143 |
| 4,143,476 | 3/1979 | Holmes et al. | 38/143 X |
| 4,313,269 | 2/1982 | Van Rumpt et al. | 38/143 |

FOREIGN PATENT DOCUMENTS

| | | | |
|---|---|---|---|
| 59041 | 9/1941 | Denmark | 38/143 |

*Primary Examiner*—Joseph E. Valenza
*Assistant Examiner*—Terrance L. Siemens
*Attorney, Agent, or Firm*—Sughrue, Mion, Zinn, Macpeak and Seas

[57] ABSTRACT

In an apparatus for feeding laundry articles to a mangle, with a spreading-out and conveying device for spreading out the laundry articles when hanging down freely and for feeding the laundry articles centrally to a belt-shaped feed conveyor conveying towards the mangle, wherein two corners of each laundry article are gripped in clamps which are arranged in pairs at a short distance from one another on the spreading-out and conveying device and which can be moved away from one another, the clamping jaws of each clamp are arranged at an angle to the vertical, and the clamping jaws of a pair of clamps are directed opposite to one another in such a manner as to form a roof shape. The clamping jaws of each clamp are also made self-clamping.

8 Claims, 7 Drawing Figures

APPARATUS FOR FEEDING LAUNDRY ARTICLES TO AN IRONING MACHINE

The invention relates to an apparatus for feeding laundry articles to a mangle, the apparatus being of the type with a spreading-out and conveying device for spreading out the laundry articles when hanging down freely and for feeding the laundry articles centrally to a belt-shaped feed conveyor conveying towards the mangle, and with a transfer device for transferring to the feed conveyor the spread-out laundry article hanging on the spreading-out and conveying device, wherein the corners of each laundry article are gripped in clamps which are arranged in pairs at a short distance from one another on the spreading-out and conveying device and which can be moved away from one another.

Such an apparatus is known. In the known apparatus, the clamps of the spreading-out and conveying device have clamping jaws arranged vertically or horizontally. A particular laundry article is introduced by the attendant into the two so designed clamps of a pair of clamps, as a rule in such a way that the left-hand corner of the laundry article on a left-hand clamp projects a few centimeters to the left and the right-hand corner of the laundry article on a right-hand clamp projects a few centimeters to the right. The projecting lengths are the outer handling regions for the attendant. Consequently, for handling reasons, the laundry articles cannot be clamped at the outermost points of the corners or up to the side edges of these. This is a disadvantage because, as a result, the side edges of the laundry articles do not hang satisfactorily, and, in the end, this also has an adverse effect on the region of the laundry articles which immediately adjoins these side edges.

Another disadvantage of the known apparatus is that, because of the design of the clamps which has just been described, the tensile stresses at the clamping point, which are exerted in the laundry articles when these are spread out, have to be absorbed by only a relatively small number of threads of the fabric of the particular laundry article which lie in the pulling direction, as a result of which, in particular, already friable laundry articles can tear. Tearing usually occurs at the centrepoint of the tensile stress, namely at the clamping point of the upper edge of the particular laundry article.

Yet another disadvantage of the known apparatus is that in connection with clamping the corners of the laundry article and/or unclamping these, for example for purposes of correction, the attendant has to actuate mechanical locking elements or electrical switches of devices exerting pressure on the clamping jaws. Because of this, the efficiency of the attendant is influenced adversely.

The object on which the invention is based is to design the apparatus of the type in question in such a way that the corners of the laundry articles are clamped up to the side edges of these when the articles are spread out and conveyed. At the same time, the tensile stress in the laundry articles will, if possible, be distributed so that the danger of tearing is reduced.

This object is achieved, according to the invention, by means characterized in that each clamp has clamping jaws lying at an angle to the vertical, and in that the clamping jaws of a pair of clamps are directed opposite to one another in such a manner as to form a roof shape.

Because of the design according to the invention, it is possible to clamp the corners of the laundry articles not only up to the side edges of these but even beyond the latter, because the handling regions for the attendant are located above the clamping point of the clamping jaws of the clamps. Thus, the clamping jaws extend obliquely to the side edges and also to the top edge of the laundry article. This oblique clamping of the corners ensures that the tensile stress in the region of the clamping point, which arises when the laundry articles are spread out, is absorbed both by a greater number of threads of fabric lying in the pulling direction and partially by the threads of fabric lying at right angles thereto or by the composite arrangement of the threads. This type of clamping leads to a better distribution of the forces arising in the laundry article.

Thus, the special design of the clamps of the apparatus according to the invention ensures that clamping of the laundry articles at least up to the side edges is possible and that the tensile stresses arising in the laundry articles when they are spread out are distributed more favourably, so that the danger of tearing is greatly reduced.

In an advantageous design of the invention, it can be envisaged that the clamping jaws of each clamp be self-clamping. This does away with the necessity that in connection with clamping the corners of the laundry articles and unclamping them again, which will possibly be required, the attendant has to actuate mechanical locking elements, switches and the like.

It can also be envisaged, in an advantageous design of the invention, that the two clamping jaws of each clamp be arranged at a distance from one another, and that there be mounted eccentrically on one of the two clamping jaws a clamping piece extending essentially over the entire length thereof, in such a way that this clamping piece is moved into a clamping position, thereby exerting a retaining force, by the lateral pull arising on the laundry article when it is spread out and by the pull exerted downwards by the weight of the laundry article. It is possible, as a result of this, both to introduce from below into the clamp and simultaneously to clamp the corner of a laundry article to be gripped and to remove the clamping effect again by pulling the laundry article further sideways and to draw the corner out from the clamp. Consequently, the attendant does not need to actuate any locking elements and/or switches at a control station when the laundry article is suspended in the clamps.

In a further advantageous design of the invention, a spring engaging on each clamping piece and acting in the direction of its clamping position can be provided. By means of this, the retaining and clamping forces can be increased if necessary, for example for heavy laundry articles.

Finally, in a further advantageous design of the invention, there can be a device which engages on the clamping piece for the controlled removal of its clamping effect and which has a lever linkage which engages on the clamping piece off-centre to its mounting in the clamping jaw and the free end of which is connected operatively to a working cylinder. This design permits abrupt removal of the clamping effect on the laundry article and consequently a perfect transfer of this to the feed conveyor.

Further advantageous embodiments are described below.

Exemplary embodiments of the invention are illustrated in the drawings and are explained in more detail below.

Figure 1:
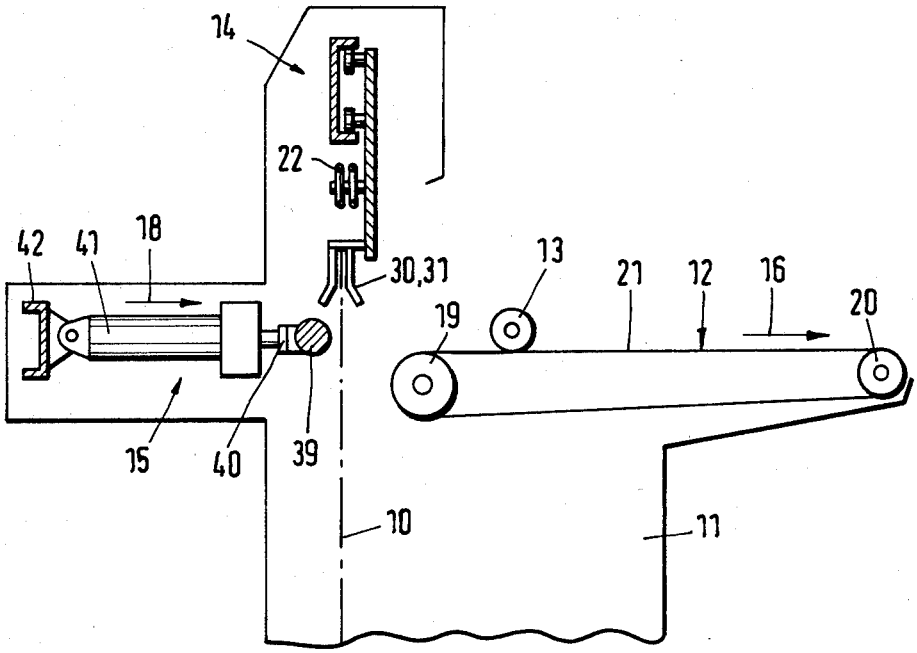
FIG. 1 shows a vertical longitudinal section through an apparatus in which the invention is applied.

The apparatus illustrated in the drawings comprises a frame 11. Located between the side walls of the frame 11, which are arranged at a distance from one another, and mounted appropriately on these are a feed conveyor 12, a pressure roller 13, a spreading-out and conveying device 14 and a transfer device 15. The feed conveyor 12 which can be seen in FIGS. 1 and 2 consists essentially of deflection rollers 19 and 20 and belts 21 guided round these. The feed conveyor 12 is driven in the direction of an arrow 16 in a way known per se by means of devices not shown. The spreading-out and conveying device 14 consists essentially of a rope drive 22 with a wire rope 27 guided round deflection rollers 25 and 26 and of two travelling carriages 28 and 29 arranged on the wire rope 27 and each having a clamp 30 and 31 respectively. The rope drive 22 is driven by means of a drive motor 23 with a chain drive 24 interposed.

Figure 2:
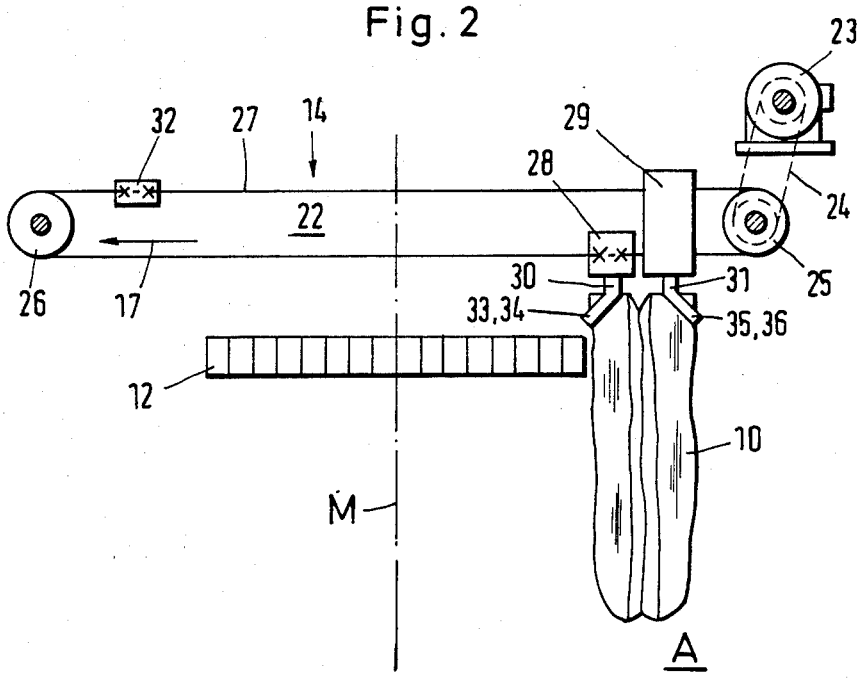
FIG. 2 shows a view of a spreading-out and conveying device of the apparatus according to FIG. 1.

To spread out a laundry article 10 (see FIG. 2) gripped in the clamps 30 and 31 at a control station "A" by an attendant (not shown), the rope drive 22 is driven so that its lower side moves in the direction of an arrow 17. At the same time, the front clamp 30, on the left in FIG. 2, is first moved in the direction of the arrow 17 and the laundry article 10 is spread out. As soon as the laundry article 10 is taut, the rear clamp 31 is towed via this or is also moved in the direction of the arrow 17.

This movement of the clamps 30 and 31 and of the laundry article 10 is continued until the laundry article 10 hangs centrally relative to the apparatus axis "M" or to the feed conveyor 12. This state of operation shown in FIG. 3 is reached when a stop 32 located on the upper side of the rope drive 22 comes to rest against the rear travelling carriage 29 on the right in FIGS. 2 and 3.

The transfer device 15 (FIG. 1) provided for transferring the spread-out laundry article 10 to the end of the feed conveyor 12 on the attendant's side consists essentially of a striking rod 39 mounted in a retaining device 40 and of a working cylinder 41 by means of which the retaining device 40 together with a striking rod 39 can be moved in the direction of an arrow 18 and in a direction opposite to this. The retaining device 40 is displaceably mounted laterally on guides located in the side walls of the frame 11, but not shown. The rear end of the working cylinder is mounted on a cross member 42 which is, in turn, fastened to the side walls of the frame 11.

Figure 3:
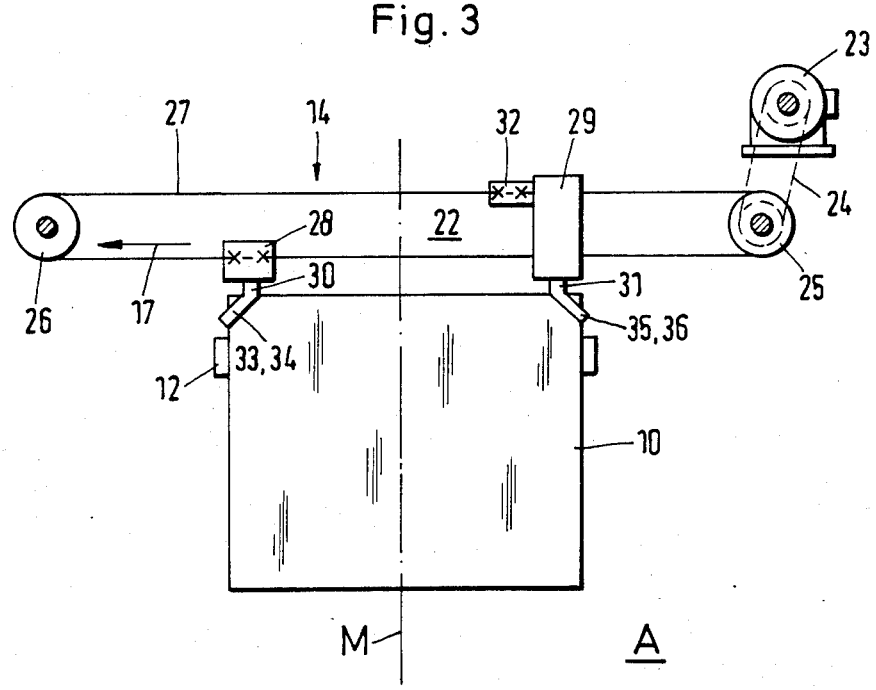
FIG. 3 shows a representation similar to FIG. 2, which shows the spreading-out and conveying device, but in a different state of operation from that of FIG. 2.

The design of the clamps 30 and 31 is evident from FIGS. 2 to 7, the opposing and roof-like arrangement of the clamping jaws 33, 34, 35 and 36 at an angle to one another being shown especially in FIGS. 2 and 3. These also show that, in the exemplary embodiment illustrated, the longitudinal direction of each of the clamping jaws extends obliquely to the gripped corner and forming an angle of 45° with the horizontal and the vertical. Moreover, FIGS. 2 and 3 clearly show that the laundry article 10 can be gripped at two of its corners beyond the side edges of the laundry article on the left and right in FIG. 3, so that there is no projecting marginal strip which is not gripped.

Figure 4:
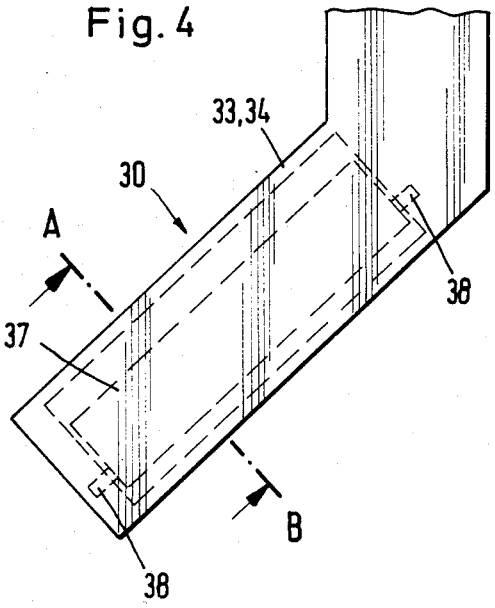
FIG. 4 shows an enlarged front view of one of two clamps of the apparatus.
Figure 5:
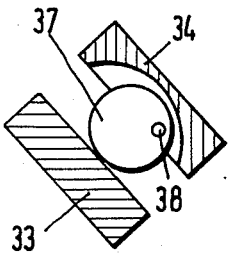
FIG. 5 shows a sectional representation according to A-B in FIG. 4.

Each clamp 30 and 31 respectively comprises two clamping jaws, namely the clamping jaws 33, 34 and 35, 36 respectively, as can be seen in FIGS. 4 and 5. The two clamping jaws of each clamp 30 and 31 respectively are arranged movably relative to one another or preferably immovably at a distance from one another. In one of the two clamping jaws of each clamp 30 and 31 respectively, a clamping piece 37 extending over the entire length thereof is mounted eccentrically, in the form of a roller, at the two ends of the clamping piece 37 by means of pins 38, in such a way that the clamping piece is pivoted into its clamping position by the lateral pull exerted by the laundry article 10 when it is spread out and by the pull exerted downwards by the weight of the laundry article 10, and thereby exerts on the laundry article a retaining force which becomes greater with the increasing strength of the two pulls mentioned. To that extent, self-reinforcement of the retaining force occurs or the clamping jaws of each clamp are self-clamping.

The apparatus has, moreover, all the other devices and parts known per se which are required for operating the apparatus, thus, for example, a retaining device (not shown) for retaining the laundry article 10 in its central region when, immediately after the clamps 30 and 31 have opened, the front end of the laundry article is thrown by the transfer device 15 abruptly onto the end of the feed conveyor 12 on the attendant's side. This retaining device, the transfer device 15 and the spreading-out and conveying device 14 are connected operatively via an electrical control device also not shown.

The mode of operation of the apparatus already emerges to a very great extent from the foregoing description. To supplement this, the following is also added:

The attendant for the apparatus introduces the laundry article 10 from below, in FIG. 2, into the clamps 30 and 31. At the same time, the eccentrically mounted clamping pieces 37 are pivoted out of their clamping position. As soon as the attendant releases the corners, the clamping pieces 37 move into the clamping position automatically and assisted by the weight of the laundry article 10 pulling downwards. If, at this moment, all the other requirements known per se for conveying the laundry article 10 in the direction of the arrow 17 are fulfilled, this conveyance begins by sequential control. Conveyance continues until the taut laundry article 10 is located centrally in front of the feed conveyor 12 (see FIG. 3). The taut and centrally positioned laundry article 10 is transferred to the feed conveyor 12 by means of the transfer device 15 as a result of the controlled movement of the striking rod 39 against the upper end of the laundry article 10, after the clamping effect of the clamps 30 and 31 has been removed immediately beforehand. The means for removing the clamping effect are not illustrated in FIGS. 4 and 5. For example, the clamping effect can be removed by pivoting away or swinging away one of the clamping jaws of each clamp.

At the same time, the laundry article 10 is retained, in a region following its front end, by the retaining device already mentioned, but not shown, so that it does not fall to the ground as a result of its own weight.

Figure 6:
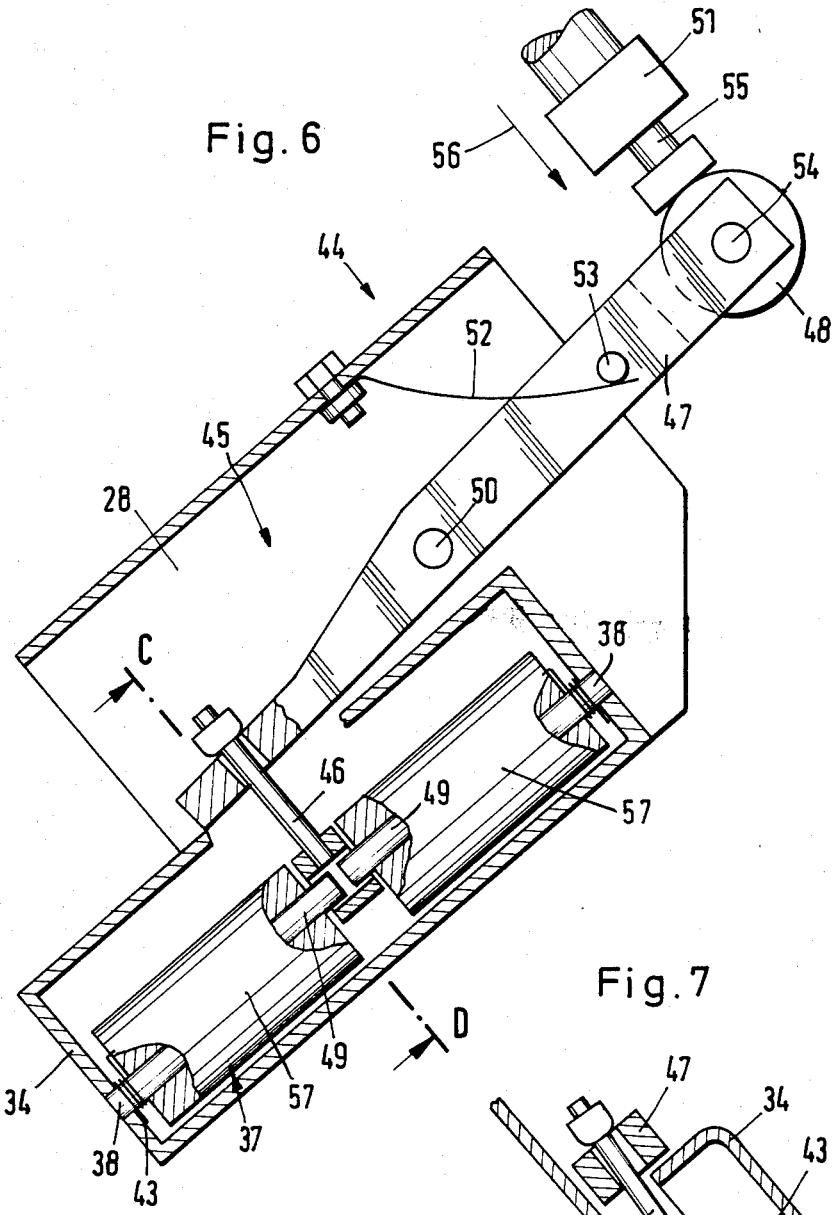
FIG. 6 shows an enlarged front view, partially in section, of a further exemplary embodiment of a clamp of the apparatus.
Figure 7:
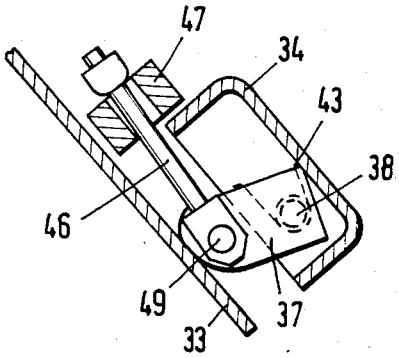
FIG. 7 shows a sectional representation according to C-D in FIG. 6.

A further exemplary embodiment of the clamps is illustrated in FIGS. 6 and 7, the following explanation of the clamp 30 shown also applying accordingly to the clamp 31. In this exemplary embodiment, the clamping piece 37 mounted eccentrically by means of the pins 38 is designed not as a roller, but as a profile piece divided in two longitudinally and consisting of two portions 57, and in addition torsional springs 43 improving the clamping effect of the clamping piece 37 are arranged on the outer pins 38 of the two-part clamping piece 37. The clamping effect can be further improved by glueing a rubber lining or the like, not shown in the drawing, to the clamping piece 37 on its contact side.

So that the gripped laundry article 10 can be released from the clamps 30 and 31 and transferred to the feed conveyor 12, that is to say for the controlled independent removal of the clamping effect of the clamping piece 37, the exemplary embodiment illustrated in FIGS. 6 and 7 has a mechanical device 44. This device 44 consists essentially of a levered linkage 45 engaging on the clamping piece 37 off-centre to its mounting in the clamping jaw 34, and of a working cylinder 51 engaging on the free end of the lever linkage. The lever linkage 45 consists essentially of a tension piece 46 and a lever 47 with a roller 48 mounted on the lever 47 by means of an axle 54. The tension piece 46 is, on the one hand, mounted on the clamping piece 37 by means of two pins 49, specifically between the two portions 57 of the clamping piece 37 (see FIG. 6), and, on the other hand, suspended on one end of the lever 47 mounted on the travelling carriage 28 by means of an axle 50. The two pins 49 are fastened eccentrically relative to the pins 38 at the ends facing one another of the two portions 57 and are not connected rigidly to one another. The two pins 49 rest with a certain play in a bearing on the tie rod 46, so that the two portions 57 can be somewhat rotated and/or displaced relative to one another, resulting in the advantage that the clamping piece 37 can be better adapted to portions of the laundry article 10 of different thicknesses.

The working cylinder 51 is mounted on the travelling carriage 28 in a way known per se and not shown. The free end of a leaf spring 52 attached to the travelling carriage 28 rests near the roller 48 against a stop 53 of the lever 47. The tension piece 46 and the roller 48 are mounted on the lever 47 so as to be freely movable.

In the exemplary embodiment according to FIGS. 6 and 7, the removal of the clamping effect of the clamping pieces 37 by the device 44 is controlled by the control device, this removal being initiated by moving the piston rod 55 of the working cylinder 51 in the direction of an arrow 56. During this operation, that is to say during removal of the clamping effect and transfer of the laundry article 10 to the feed conveyor 12, as in the case described previously the laundry article 10 is retained, in a region following its front end, by the retaining device (not shown), so that it does not fall onto the floor as a result of its own weight.

The return movement of the clamping pieces 37 into their basic position after the laundry article 10 has been delivered to the feed conveyor 12 is carried out after the controlled return of the piston rod 55 by means of the working cylinder 51 and of the lever 47 by means of the leaf spring 52, as a result of the clamping pieces' own weight and because of the force of the torsional springs 43. Moreover, the mode of operation of the apparatus with the clamps according to FIGS. 6 and 7 is the same as described above for the exemplary embodiment according to FIGS. 4 and 5.

Thus, in brief, the invention relates to an apparatus for feeding laundry articles to a mangle, with a spreading-out and conveying device for spreading out the laundry article when hanging down freely and for feeding the laundry articles centrally to a belt-shaped feed conveyor conveying towards the mangle, wherein two corners of each laundry article are gripped in clamps which are arranged in pairs at a short distance from one another on the spreading-out and conveying device and which can be moved away from one another. The clamping jaws of each clamp are arranged at an angle to the vertical, and the clamping jaws of a pair of clamps are directed opposite to one another in the manner of a roof. The clamping jaws of each clamp are made preferably self-clamping.

I claim:

1. Apparatus for feeding laundry articles to a mangle or the like, with a horizontal spreading-out and conveying device for spreading out the laundry articles when hanging down vertically and freely and for feeding the laundry articles centrally to a belt-shaped feed conveyor conveying towards the mangle, and with a transfer device for transferring to the feed conveyor the spread-out laundry article hanging on the spreading-out and conveying device, wherein two corners of each laundry article are gripped in clamps which are arranged in pairs at a short distance from one another on the spreading-out and conveying device and which can be moved away from one another, characterised in that each clamp (30, 31) has clamping jaws (33, 34 and 35, 36 respectively) lying at an angle to the vertical, and in that the clamping jaws of a pair of clamps are divergent downwardly and extend across an upper corner of the article, the clamping jaws of each clamp being self-clamping in both the horizontal and vertical directions.

2. Apparatus according to claim 1, characterised in that the two clamping jaws (33, 34 and 35, 36 respectively) of each clamp (30 and 31 respectively) are arranged at a distance from one another, and in that a clamping piece (37) extending essentially over the entire length of each clamp is mounted eccentrically on one of the two clamping jaws (34 and 36 respectively) of each clamp, in such a way that this clamping piece is moved into a clamping position, thereby exerting a retaining force, by the lateral pull arising on the laundry article (10) when the latter is spread out and by the pull exerted downwards by the weight of the laundry article (10).

3. Apparatus according to claim 2, characterised by a spring (43) which engages on each clamping piece (37) and which acts in the direction of its clamping position.

4. Apparatus according to claim 3, characterised in that the clamping piece (37) is mounted by means of at least one pin (38), and in that the spring is designed as a torsional spring (43) located on the pin.

5. Apparatus according to any one of claims 2 to 4, characterised by a device (44) engaging on the clamping piece (37) for the controlled removal of its clamping effect.

6. Apparatus according to claim 5, characterised in that the device (44) has a lever linkage (45) which engages on the clamping piece (37) off-centre relating to its mounting in the clamping jaw (34 and 36 respectively) and the free end of which is connected operatively to a working cylinder (51).

7. Apparatus according to claim 6, characterised in that the clamping piece (37) consists of two portions (57) which are mounted in the clamping jaw (34 and 36 respectively) at their ends facing away from one another and which are mounted at their ends facing one another on a tie rod (46) of the lever linkage (45) in such a way that the two portions are movable relative to one another.

8. Apparatus for feeding of laundry article to a mangle or the like, including a horizontal spreading and conveying device (14) for spreading the laundry article (10) in a vertically freely hanging condition and for feeding the laundry article (10) to a belt-shaped feed conveyor (12) toward the mangle, and including a transfer device (15) for transferring the laundry article (10), hanging spread out on the spreading and conveyor device (14), to the feed conveyor (12), wherein two corners of each laundry article (10) are gripped by clamps (30, 31), which are arranged in pairs spaced at short distances on the spreading and conveyer device (14) and which are moveable away from each other, characterized in that each clamp (30 or 31) has clamping jaws (33, 34 or 35, 36) for self-clamping across one upper corner of a laundry article, and in that the clamping jaws (33, 34 or 35, 36) of the clamps (30 or 31) are arranged at an acute angle to the vertical and are divergent downwardly in the plane of the laundry article as well as in the plane perpendicular to the plane of the article, the clamping jaws of each clamp being self-clamping in both the horizontal and vertical directions.

* * * * *